US007226040B2

(12) United States Patent
Keister

(10) Patent No.: US 7,226,040 B2
(45) Date of Patent: Jun. 5, 2007

(54) POWER SUPPLY WINCH SYSTEM

(75) Inventor: Daniel James Keister, Merriam, KS (US)

(73) Assignee: Time Warner Cable, Inc., Stamford, CT (US)

( * ) Notice: Subject to any disclaimer, the term of this patent is extended or adjusted under 35 U.S.C. 154(b) by 12 days.

(21) Appl. No.: 11/209,073

(22) Filed: Aug. 22, 2005

(65) Prior Publication Data

US 2007/0040158 A1 Feb. 22, 2007

(51) Int. Cl.
*B66D 1/00* (2006.01)

(52) U.S. Cl. ..... 254/324; 254/380

(58) Field of Classification Search ..... 254/261, 254/262, 263, 324, 380
See application file for complete search history.

(56) References Cited

U.S. PATENT DOCUMENTS 1,097,643 A * 5/1914 Jones ..... 254/376
1,403,962 A * 1/1922 Jolly ..... 254/380
3,361,411 A * 1/1968 Reigh ..... 254/266
3,494,492 A * 2/1970 Thiermann ..... 414/461
3,801,069 A * 4/1974 McCarstle ..... 254/326
4,290,584 A * 9/1981 Eckels et al. ..... 254/380
4,543,905 A * 10/1985 McKenney ..... 116/63 P
5,772,183 A * 6/1998 Sears ..... 254/324
5,788,095 A * 8/1998 Watson ..... 212/180
6,089,809 A * 7/2000 Dellinger ..... 414/11
6,238,171 B1 * 5/2001 Carter ..... 414/563
6,250,483 B1 * 6/2001 Frommer ..... 212/180
7,111,826 B2 * 9/2006 Cook et al. ..... 254/329
7,118,095 B1 * 10/2006 Stidham et al. ..... 254/375

* cited by examiner

*Primary Examiner*—Emmanuel M Marcelo
(74) *Attorney, Agent, or Firm*—Roberts, Mardula & Wertheim, LLC

(57) ABSTRACT

The power supply winch system comprises a generally inverted L-shaped supportive frame and a winch attached to the supportive frame. The supportive frame comprises a horizontal member and a vertical member that are pivotally attached to one another at one end. The horizontal member has a first horizontal stability bar attached thereto and a flexible strap which depends from a free end of the horizontal member. The vertical member has a winch support affixed to it and a second horizontal stability bar attached to a free end of the vertical member. The winch is secured to the winch support. The inverted L-shaped supportive frame can embrace a corner of the power supply cabinet, such that the horizontal member corresponds with a top surface of the cabinet while the vertical member corresponds with an adjacent side surface. The winch system can be folded into a compact, portable structure.

26 Claims, 6 Drawing Sheets

POWER SUPPLY WINCH SYSTEM

BACKGROUND

Embodiments of the present invention are generally related to cable communication systems and more specifically directed to installation of cable network devices on elevated structures. A power supply worker is often required to work at heights in order to accomplish certain tasks. For example, in order to service most power supply equipment, a power supply worker must access power supply cabinets that are situated at a high elevation on a utility pole, telephone pole, power pole or other such structure. For purposes of this application and without limitation, these structures will be referred to as "utility poles." Performing work at an elevation becomes particularly dangerous, however, when the power supply worker is also required to lift heavy power supply equipment such as a battery or power unit. Typically, such power supply equipment weighs at least sixty-five pounds. If the weight of the worker or the equipment is not adequately supported, the consequences could be disastrous.

To reduce some of the risks associated with servicing power supply equipment, a bucket truck is often used to lift the worker and the equipment to the desired height. However, there are instances when a bucket truck does not allow a worker sufficient access to the power supply cabinet. In order to access the power supply cabinet in these instances, a power supply worker has no choice but to use a ladder. The power supply worker must carry the heavy power supply equipment while climbing the ladder to the desired elevation. Needless to say, if the worker is unable to support the weight of the equipment even for a moment during this endeavor, the worker could fall and sustain serious injury. Consequently, what is needed is a device which allows a power supply worker to raise heavy components to the level at which the worker is working, in a safe and effective manner.

SUMMARY

An embodiment of the present invention comprises a winch system and method for lifting a battery or power supply unit to a power supply cabinet situated at a high elevation, typically on a utility pole. The system comprises a generally inverted L-shaped supportive frame and a winch attached to the supportive frame. The supportive frame comprises a horizontal member and a vertical member that are pivotally attached to one another at one end. The horizontal member has a first horizontal stability bar attached to it and a flexible strap which depends from a free end of the horizontal member. The vertical member has a winch support affixed to it and a second horizontal stability bar welded to a free end of the vertical member. The winch is secured to the winch support.

The inverted L-shaped supportive frame can be positioned to embrace a corner of the power supply cabinet, such that the horizontal member corresponds with a top surface of the cabinet while the vertical member corresponds with an adjacent side surface. When not in use, the winch system can be folded into a compact, portable structure.

It is therefore an aspect of the present invention to provide a power supply winch system to assist in lifting power supply equipment to a worker who is situated at an elevated position on a ladder.

It is another aspect of the present invention to provide a power supply winch system which can easily be carried by a power supply worker while the worker is climbing a ladder.

It is yet another aspect of the present invention to provide a power supply winch system which is foldable.

It is a further aspect of the present invention to provide a power supply winch system which can be easily fastened to a power supply cabinet.

These and other aspects of the present invention will become apparent to those skilled in the art from a review of the information that follows.

In an embodiment of the present invention, a power supply winch system comprises a generally inverted L-shaped supportive frame and a winch attached to the supportive frame. The supportive frame comprises a horizontal member and a vertical member pivotally attached to the horizontal member. The winch comprises a drum around which a flexible length of lifting material is wound. The supportive frame can be made from metal, fiberglass, aluminum, or any other suitable material. The lifting material can be a nylon strap, rope, chain, cable or other suitable material.

In another embodiment of the present invention, the horizontal member comprises a first horizontal stability bar that is disposed normal to the horizontal member. The horizontal member can be made from one piece or from two telescoping pieces.

In one embodiment of the present invention, the horizontal member comprises a strap attached to one end of the horizontal member. In another embodiment of the present invention, the strap comprises a hook.

In yet another embodiment of the present invention, the vertical member comprises a second horizontal stability bar attached to one end of the vertical member. The vertical member comprises a winch support for retaining the winch.

In another embodiment of the present invention, the power supply winch system comprises an L-shaped bracket. The L-shaped bracket is configured to receive an end of the vertical member and an end of the horizontal member.

In one embodiment of the present invention, the winch is motor-driven. In another embodiment of the present invention, the winch is hand-powered. In yet another embodiment of the present invention, the winch comprises a removable handle.

In another embodiment of the present invention, a method for lifting power supply equipment to a power supply cabinet situated at an elevation comprises securing a power supply winch system to the power supply cabinet. The power supply winch system comprises a generally inverted L-shaped supportive frame and a winch attached to the supportive frame. The supportive frame has a horizontal member and a vertical member pivotally attached to the horizontal member. The winch comprises a drum around which a flexible length of lifting material is wound. The method of the present invention further comprises attaching the lifting material to the equipment and operating the winch to lift the material to the power supply cabinet.

DETAILED DESCRIPTION

Figure 1:
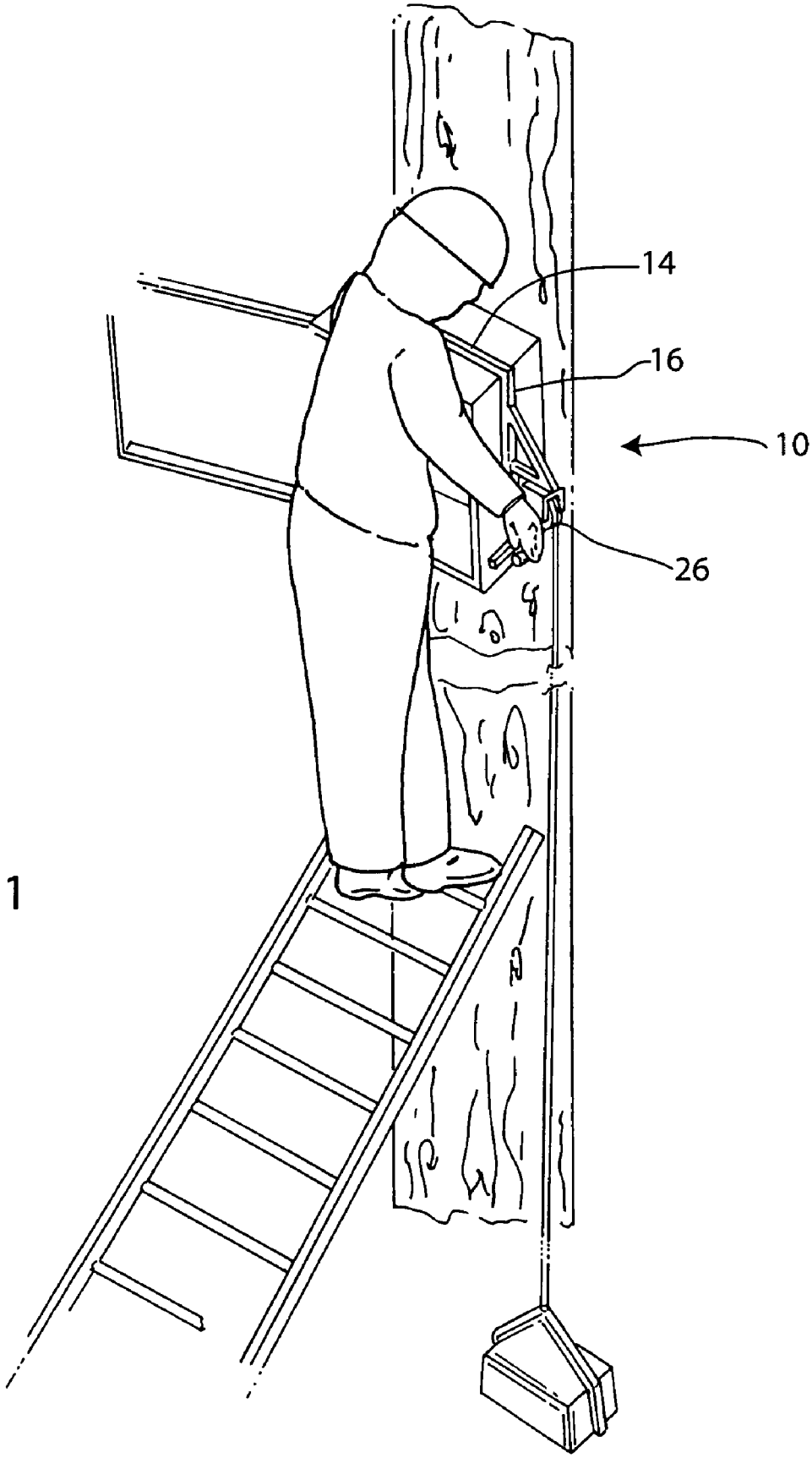
FIG. 1 illustrates a perspective environmental view of an embodiment of the present invention.

An embodiment of the present invention comprises a winch system, generally designated as 10 in the drawings. FIG. 1 illustrates a perspective, environmental view of one embodiment of the present invention. Winch system 10 can be used for lifting power supply equipment, such as a battery or a power supply unit, to a power supply cabinet situated at a high elevation.

Figure 2:
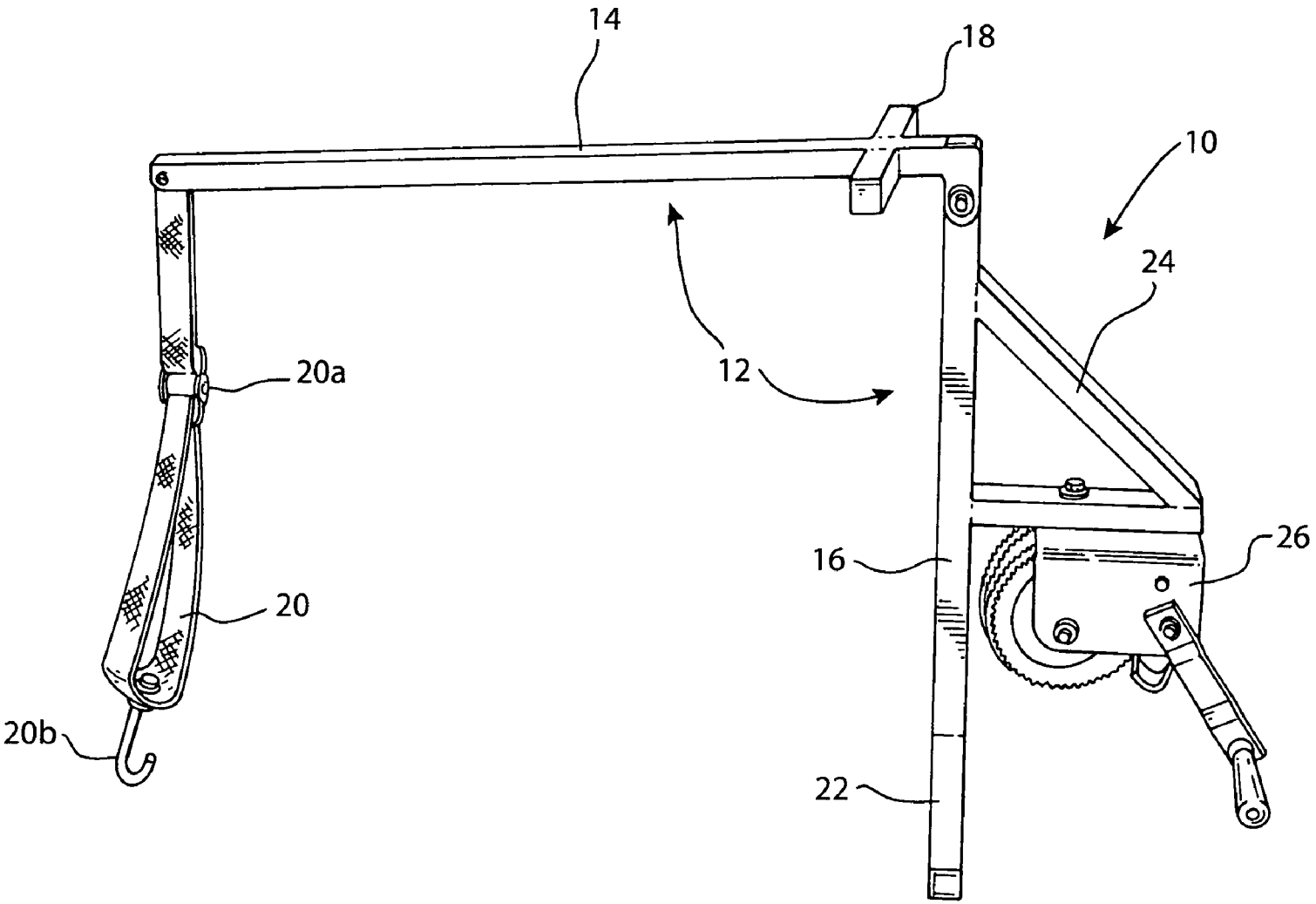
FIG. 2 illustrates a side view of an embodiment of the present invention.

Referring to FIG. 2, a side view of an embodiment of the present invention is illustrated. The winch system 10 comprises a generally inverted L-shaped supportive frame 12 and a winch 26 attached to the supportive frame 12. The supportive frame 12 comprises a horizontal member 14 and a vertical member 16 that are pivotally attached to one another at one end.

The horizontal member 14 can be made from one piece or from two or more telescoping pieces to allow for length adjustment of the horizontal member 14. Suitable material for the horizontal and vertical members of the present invention may be, without limitation, metal of varying types, fiberglass, heavy plastics, wood, or any other suitably strong material capable of supporting the weight of equipment being lifted. Horizontal member 14 further comprises a scuff protector(s) (not shown) attached to the side of the horizontal member that comes in contact with the power supply cabinet. This cushions the present invention against the power supply cabinet as power supplies are hoisted to the cabinet. Scuff protectors can be made from any cushioning material such as, without limitation, rubber, latex, felt, other types of padding known in the art.

A first horizontal stability bar 18 is attached to the horizontal member 14. The first horizontal stability bar 18 is disposed at a right angle to the horizontal member 14. The purpose of the stability bar 18 is to ensure that the system does not rotate about the horizontal axis during any lifting operations. Additionally, stability bar 18 serves to distribute the weight of the component being lifted so as not to stress the power supply cabinet at any one point. Hence, the stability bar 18 may also comprise other shapes that accomplish similar purposes and be positioned at different orientations to the horizontal member 14. As with the horizontal member 14 first horizontal stability bar 18 may also comprise scuff protectors to protect the power supply cabinet during power supply installation operations. It should also be understood that, while only one horizontal stability bar 18 is depicted in the drawings, the horizontal member 14 may include more than one horizontal stability bar 18, if needed.

Vertical member 16 may also further comprise a scuff protector(s) attached to the side of the vertical member that comes in contact with the power supply cabinet. This also further cushions the present invention against the power supply cabinet as power supplies are hoisted to the cabinet. Scuff protectors can be made from any cushioning material such as, without limitation, rubber, latex, felt, other types of padding known in the art.

Figure 3:
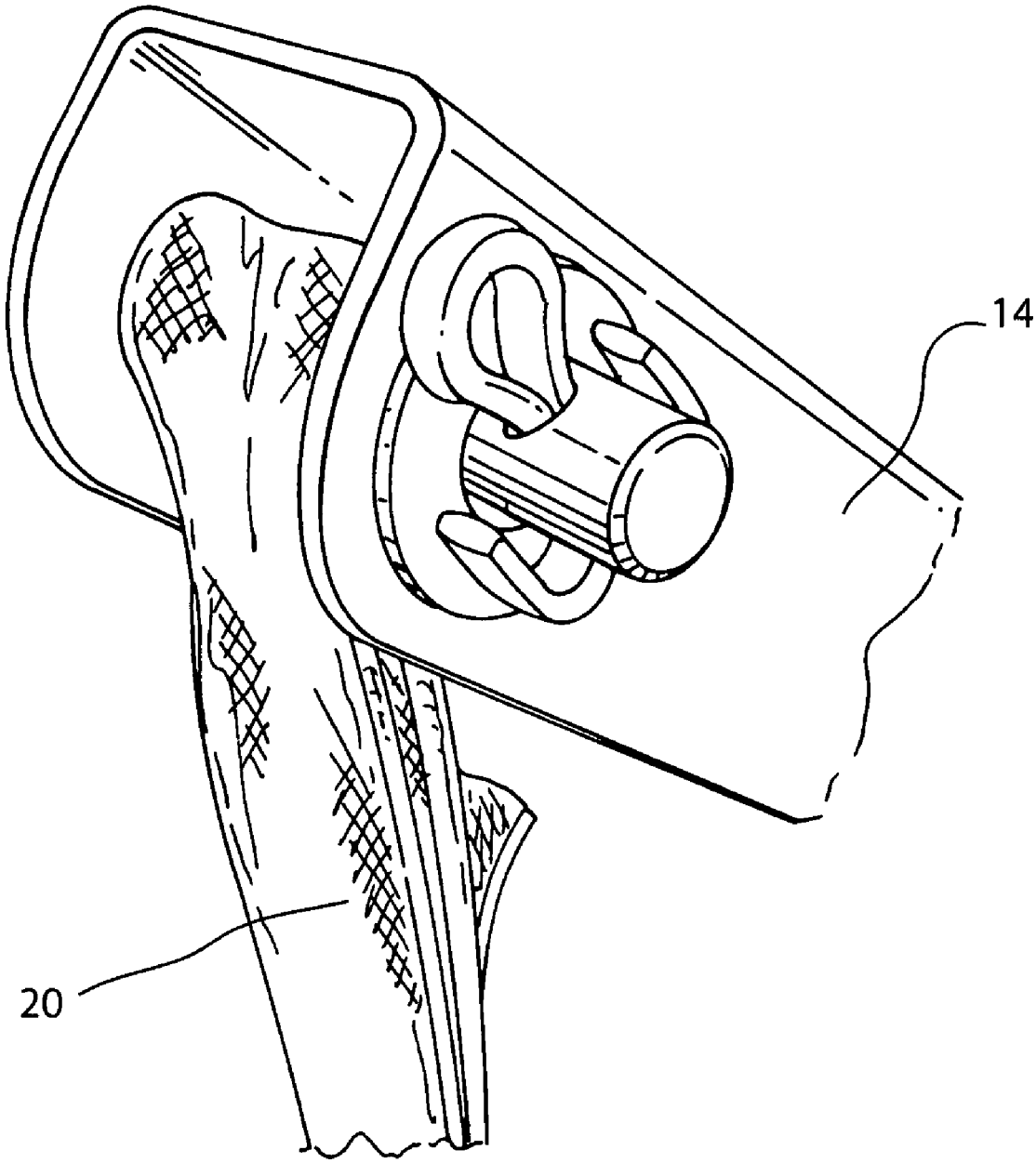
FIG. 3 illustrates perspective view of a strap attached to one end of the horizontal member according to one embodiment of the present invention.

In one embodiment of the present invention, the horizontal member 14 comprises a flexible strap 20. The flexible strap 20 can be made from nylon, plastic, or any other suitable material. The flexible strap 20 may comprise a tightening mechanism 20*a* wherein the flexible strap 20 length can be adjusted for a tight fit around the dimensions of the equipment cabinet. A buckle pull down strap is one such example of a tightening mechanism known in the art although this is not meant as a limitation. In one embodiment of the present invention, the flexible strap 20 further comprises a hook 20*b*. Such a hook 20*b* can be used to attach to any raised ridges of the power supply cabinet or to extend around the entire cabinet and attach to the vertical member 16 or the horizontal member 14 of the system 10 (see FIG. 1). FIG. 3 shows the flexible strap 20 attached to a free end of the horizontal member 14.

Figure 4:
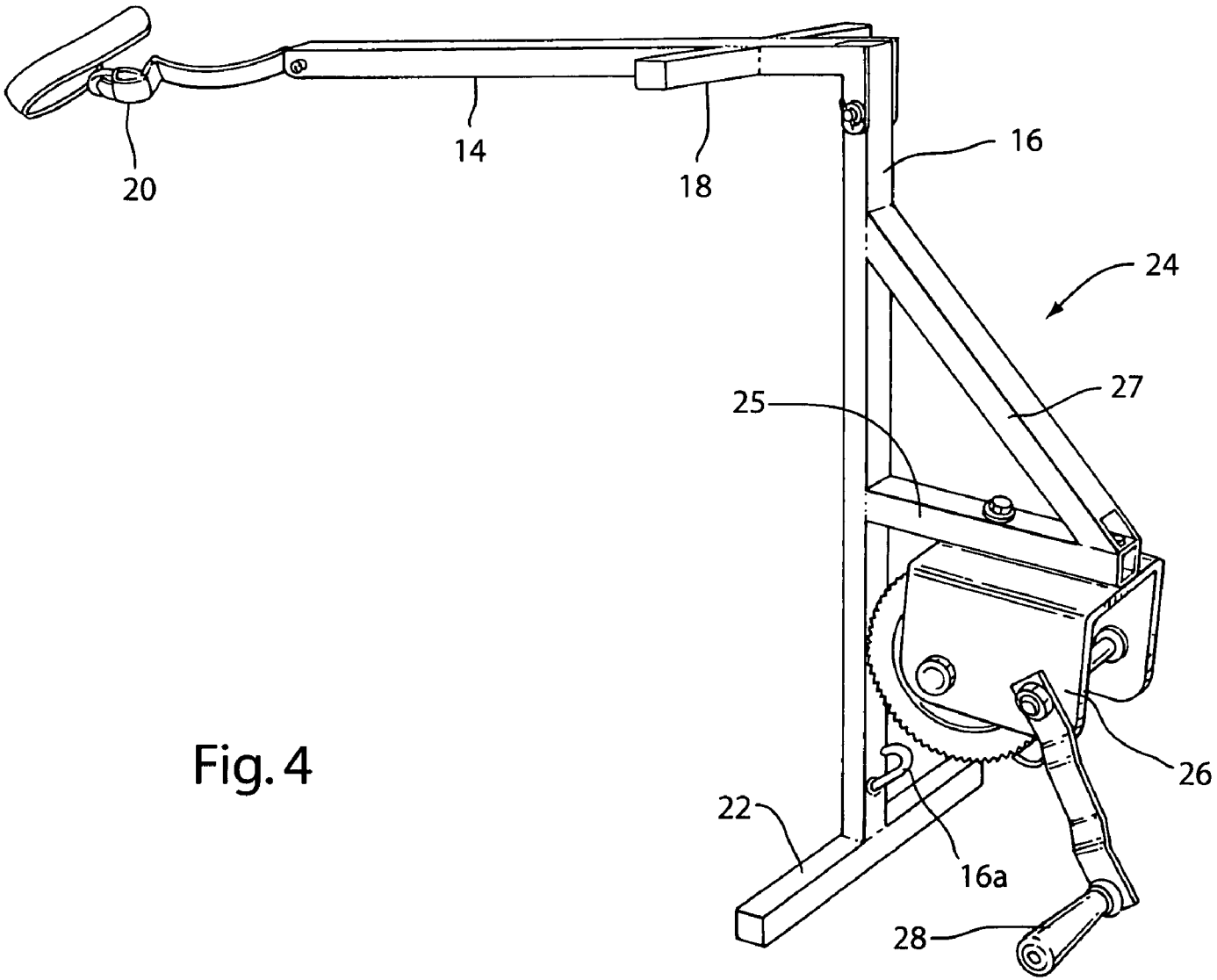
FIG. 4 illustrates a perspective side view of an embodiment of the present invention.

The vertical member 16 comprises a second horizontal stability bar 22 for preventing rotation about the vertical axis during the lifting of components, as illustrated in FIG. 4. Again, stability bar 22 may take other shapes as well to accomplish the stability desired. As with the first horizontal stability bar 18 second horizontal stability bar 22 may also comprise scuff protectors to protect the power supply cabinet during power supply installation operations. Additionally, the vertical member 16 may include more than one horizontal stability bar 22 to further stabilize the system 10. In one embodiment of the present invention, the vertical member 16 further comprises an attachment point 16*a* to its lower end to allow the flexible strap 20 to be connected thereto.

Referring to FIG. 4, a winch support 24 is attached to the vertical member 16 to which the winch 26 may be secured. The winch support 24 can be configured in any manner which would provide suitable support for the winch. In one embodiment of the present invention, the winch support 24 comprises a first arm 25 and a second arm 27. The first arm 25 and the second arm 27 are connected to each other at one end and to the vertical member 16 at an opposing end. Preferably, the first arm 25 forms a right angle with the vertical member 16 and the winch depends from the first arm 25 of the winch support 24. When the first arm 25 and second arm 27 are made from metal tubing or other types of tubing material and joined together by a bolt, as shown in FIG. 4, one or more spacers can be disposed inside the first arm 25 to keep the tubing from collapsing.

Any suitable winch 26, comprising a drum around which a flexible length of lifting material is wound, may be used in the present invention. The lifting material can be a rope, chain, strap, cable, or other suitable material for attachment to the equipment being lifted. A strap made from nylon is particularly preferred for the lifting material of the present invention. The winch 26 can be motor-driven, having a gas or electric motor. Alternatively, the winch 26 can be hand-powered, having a handle 28 which can be turned to rotate the drum and thereby, hoist the equipment attached to the lifting material. In one embodiment of the present invention, the winch 26 comprises a socket and handle 28 which is removably positioned within the socket. In this embodiment, the handle may be replaced with an electric drill, so that operation of the electric drill may also serve to rotate the drum and hoist the equipment attached to the lifting material.

Figure 5:
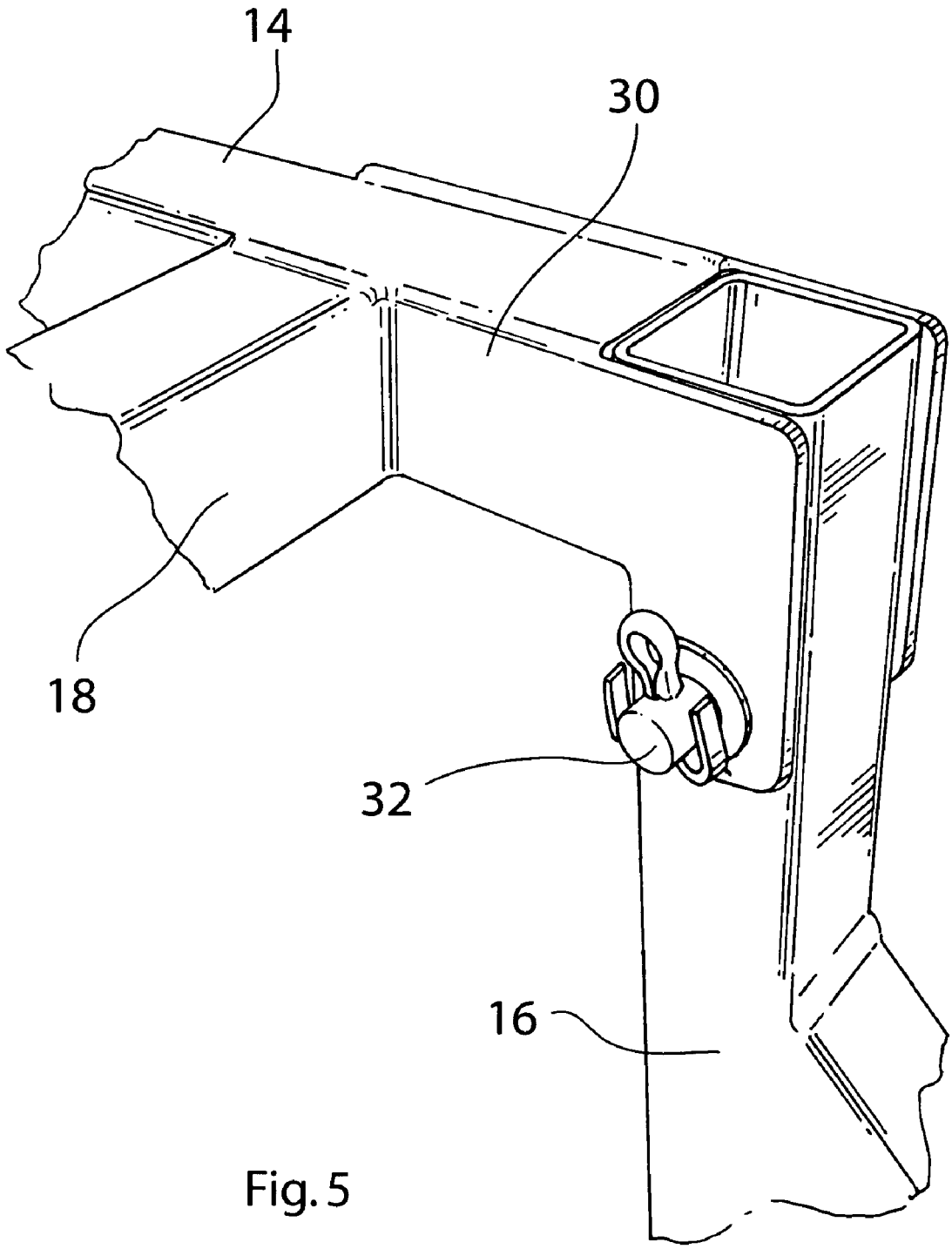
FIG. 5 illustrates a partial side view of an embodiment of the present invention showing the horizontal member and the vertical member joined by the L-shaped bracket.
Figure 6:
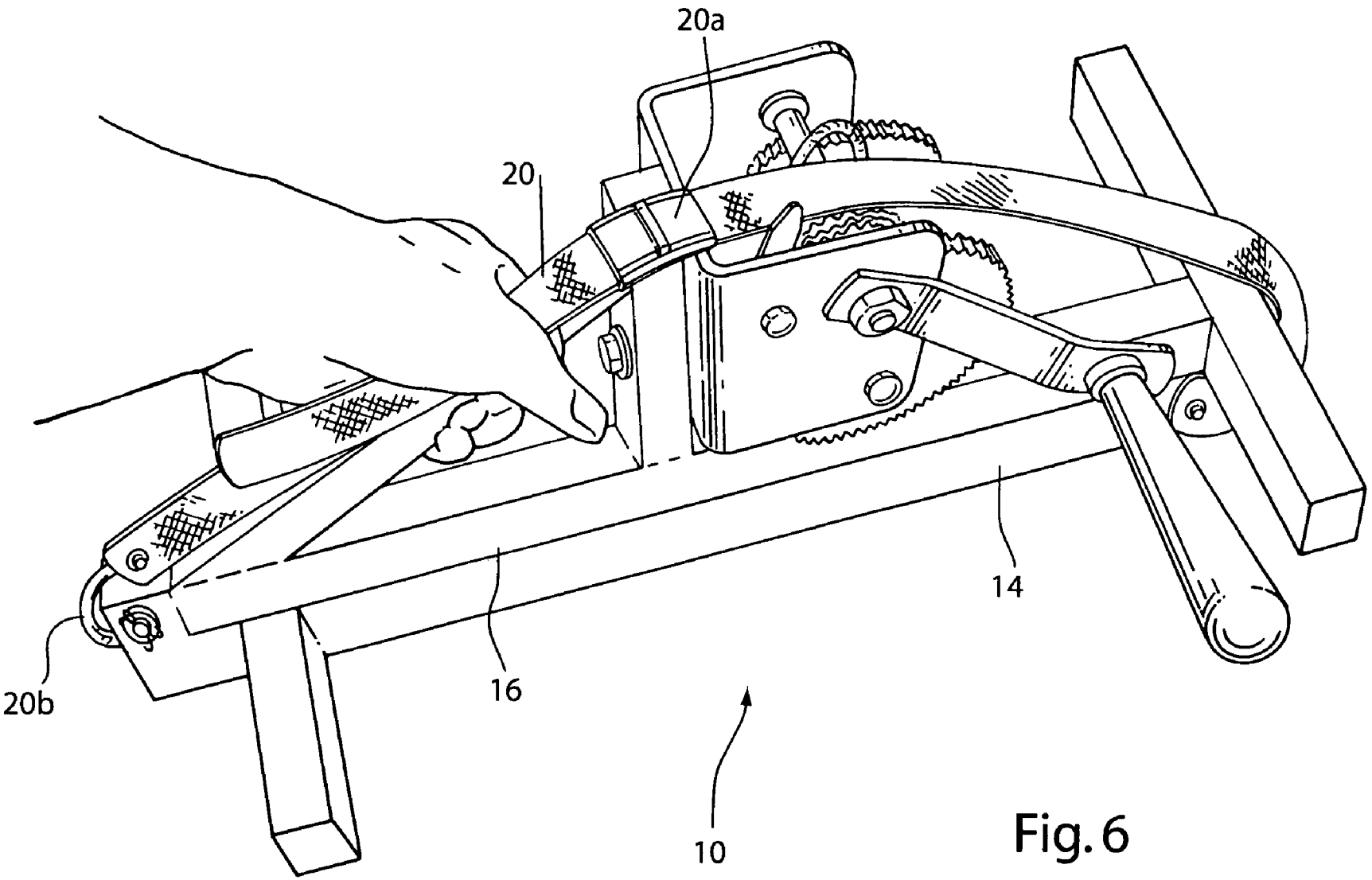
FIG. 6 illustrates a perspective side view of an embodiment of the present invention when the support frame is folded.

The horizontal member 14 and the vertical member 16 can be pivotally attached to one another in any suitable manner to allow folding of the supportive frame 12. In one embodiment of the present invention, an L-shaped bracket 30 is used to join the horizontal member 14 and the vertical member 16, as is illustrated in FIG. 5. The horizontal member 14 is fixedly attached to the L-shaped bracket 30, as by welding or any other method that allows for a rigid attachment to the horizontal member. The vertical member 16 is pivotally attached to the L-shaped bracket using a cotter pin 32, or other suitable attachment device. Pivoting of the vertical member 16 allows the supportive frame 12 to be folded, as shown in FIG. 6. It should be understood that while pivoting of the vertical member 16 is preferred, the supportive frame 12 may be configured to allow pivoting of the horizontal member 14 instead.

The supportive frame 12 is made from any suitable lightweight material, comprising, but not limited to, metal, fiber glass, or aluminum tubing.

The winch system 10 is easily secured to a standard power supply cabinet. Referring again to FIG. 2, the inverted L-shaped supportive frame 12 is positioned to embrace a corner of the power supply cabinet, such that the horizontal member 14 corresponds with a top surface of the cabinet while the vertical member 16 corresponds with an adjacent side surface. The first horizontal stability bar 18 and the second horizontal stability bar help to maintain the frame 12 in place on the power supply cabinet and prevent the system 10 from rotating about the horizontal or vertical axis. The first horizontal stability bar 18 also facilitates distribution of the weight of the equipment that is being lifted by the winch.

The flexible strap 20 or hook 20*b* can be used to further secure the winch system 10 to the cabinet. For example, the flexible strap 20 can be drawn around the side of the cabinet and attached to a bottom ledge of the cabinet. The hook 20*a* can be configured to clasp the edge of the cabinet top upon which the horizontal member 14 rests. Referring to FIG. 6, flexible strap 20 and hook 20*b* can be used to secure the entire unit together when it is being carried from job to job. Flexible strap 20 comprises a buckle pull down type of adjustable buckle 20*a* so that the strap can be tightened onto the power supply cabinet as well as tightened down to secure the power supply winch in a folded position for easy carrying.

A power supply winch system and method for using a power supply has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular. Moreover, a reference to a specific time, time interval, and instantiation of scripts or code segments is in all respects illustrative and not limiting.

What is claimed is:

1. A power supply winch system comprising:

a generally inverted L-shaped supportive frame, the supportive frame comprising a horizontal member and a vertical member pivotally attached to a proximal end of the horizontal member; and a winch attached to the vertical member of the supportive frame comprising a lifting material, said lifting material having one free end to which a load may be connected.

2. The power supply winch system according to claim 1, wherein:

the horizontal member comprises a first horizontal stability bar, the first horizontal stability bar being disposed normal to the horizontal member.

3. The power supply winch system according to claim 1, wherein:

the horizontal member comprises a strap attached at a first end to a distal end of the horizontal member.

4. The power supply winch system according to claim 3, wherein:

the strap comprises a hook.

5. The power supply winch system according to claim 1, wherein:

the vertical member comprises a second horizontal stability bar attached to one end of the vertical member.

6. The power supply winch system according to claim 1, wherein:

the vertical member comprises a winch support to which the winch is attached.

7. The power supply winch system according to claim 1, wherein:

the horizontal member is unitary.

8. The power supply winch system according to claim 1, wherein:

the horizontal member comprises two telescoping pieces.

9. The power supply winch system according to claim 1, wherein the supportive frame is constructed from material selected from the group consisting:

metal, fiberglass, aluminum, wood, polymer, and steel.

10. The power supply winch system according to claim 1, further comprising an L-shaped bracket, the L-shaped bracket being configured to receive one end of the vertical member and the horizontal member.

11. The power supply winch system according to claim 10, wherein:

the horizontal member is rigidly attached to the L-shaped bracket, and the vertical member is pivotally attached to the L-shaped bracket.

12. The power supply winch system according to claim 10, wherein:

the horizontal member is pivotally attached to the L-shaped bracket, and the vertical member is rigidly attached to the L-shaped bracket.

13. The power supply winch system according to claim 1, wherein the lifting material is selected from the group consisting of nylon, cable, chain, and rope.

14. The power supply winch system according to claim 1, wherein the winch is motor-driven.

15. The power supply winch system according to claim 14, wherein the winch comprises an electric motor.

16. The power supply winch system according to claim 14, wherein the winch comprises a gasoline powered motor.

17. The power supply winch system according to claim 1, wherein the L-shaped supportive frame comprises a scuff protector.

18. The power supply winch system according to claim 17, wherein the scuff protector is disposed on the horizontal member.

19. The power supply winch system according to claim 17, wherein the scuff protector is disposed on the first horizontal stability bar.

20. The power supply winch system according to claim 17, wherein the scuff protector is disposed on the vertical member.

21. The power supply winch system according to claim 17, wherein the scuff protector is disposed on the second horizontal stability bar.

22. The power supply winch system according to claim 17, wherein the scuff protector is manufactured from a material selected from the group consisting of rubber, latex, and felt.

23. The power supply winch system according to claim 1, wherein the winch is hand-powered.

24. The power supply winch system according to claim 23, wherein the winch comprises a removable handle.

25. A method for lifting power supply equipment to a power supply cabinet situated at an elevation comprising:

securing a power supply winch system to the power supply cabinet, the power supply winch system comprising a generally inverted L-shaped supportive frame having a horizontal member and a vertical member pivotally attached to the horizontal member and a winch attached to the supportive frame, the winch comprising a drum around which a flexible length of lifting material is wound;

attaching the lifting material to the power supply equipment; and operating the winch to lift the power supply equipment to the power supply cabinet.

26. A power supply winch system for attachment to a power supply cabinet comprising:

a generally inverted L-shaped supportive frame for embracing a corner of the power supply cabinet, the supportive frame comprising a horizontal member and a vertical member pivotally attached to a proximal end of the horizontal member;

a first horizontal stability bar disposed normal to the horizontal member for preventing rotation about the horizontal axis;

a second horizontal stability bar attached to one end of the vertical member for preventing rotation about the vertical axis;

a strap attached at a first end to a distal end of the horizontal member for securing the L-shaped supportive frame to the power supply cabinet;

a winch support attached to the vertical member; and a winch secured to the winch support.

* * * * *